United States Patent [19]

Clark, Jr. et al.

[11] Patent Number: 4,775,818

[45] Date of Patent: Oct. 4, 1988

[54] LIQUID METAL ION SOURCE AND ALLOY

[75] Inventors: William M. Clark, Jr., Thousand Oaks; Mark W. Utlaut, Saugus, both of Calif.; Robert G. Behrens, Los Alamos, N. Mex.; Eugene G. Szklarz, Los Alamos, N. Mex.; Edmund K. Storms, Los Alamos, N. Mex.; Robert P. Santandrea, Santa Fe, N. Mex.; Lynwood W. Swanson, McMinnville, Oreg.

[73] Assignees: Hughes Aircraft Company, Los Angeles, Calif.; Oregon Graduate Center, Beaverton, Oreg.; The United States of America as represented by the United States Department of Energy, Washington, D.C.

[21] Appl. No.: 851,757

[22] Filed: Apr. 14, 1986

[51] Int. Cl.[4] ..... H01J 27/02

[52] U.S. Cl. ..... 313/230; 313/362.1

[58] Field of Search ..... 313/361.1, 230, 232, 313/163; 250/425, 423 R

[56] References Cited

U.S. PATENT DOCUMENTS 4,367,429 1/1983 Wang et al. ..... 313/362.1

FOREIGN PATENT DOCUMENTS 0140979 10/1984 European Pat. Off. .
2087139 5/1982 United Kingdom .
2150745 7/1985 United Kingdom .

OTHER PUBLICATIONS

"B, As and Si Field Ion Sources", *Japanese Journal of Applied Physics*, vol. 19, No. 10, 10/1980, pp. 595–598.

Shiokawa et al., "100 keV Focused Ion Beam System with a ExB Mass Filter for Maskless Ion Implantation," *J. Vac. Sci. Tech.* 1983, pp. 1117–1120.

S. V. Muchaik et al., "Reaction Between Nickel and Phosphorus Powders Under Combustion Conditions," *Poroshkovaya Metallurgiya*, pp. 7–12, 1979.

S. V. Muchnik et al., "Reaction of Titanium with Phosphorus under Combustion Conditions," *Izvestiya Akadamii Nauk SSSR*, pp. 256–258, 1982.

S. V. Muchnik, "Formation of Cobalt Phosphides During Combustion," *Izvestiya A Akademii Nauk SSSR*, pp. 608–610, 1979.

V. B. Chernogorenko et al., "Preparation of Phosphides in the Combustion Region," *Mat Res Bull.*, vol. 16, pp. 1–6, 1981.

*Primary Examiner*—David K. Moore
*Assistant Examiner*—Sandra L. O'Shea
*Attorney, Agent, or Firm*—Wanda K. Denson-Low; V. G. Laslo; A. W. Karambelas

[57] ABSTRACT

A liquid metal ion source and alloy, wherein the species to be emitted from the ion source is contained in a congruently vaporizing alloy. In one embodiment, the liquid metal ion source acts as a source of arsenic, and in a source alloy the arsenic is combined with palladium, preferably in a liquid alloy having a range of compositions from about 24 to about 33 atomic percent arsenic. Such an alloy may be readily prepared by a combustion synthesis technique. Liquid metal ion sources thus prepared produce arsenic ions for implantation, have long lifetimes, and are highly stable in operation.

13 Claims, 3 Drawing Sheets

LIQUID METAL ION SOURCE AND ALLOY

BACKGROUND OF THE INVENTION

The U.S. government has rights in this invention pursuant to Contract No. 83 F842300.

This invention relates to liquid metal ion sources, and, more particularly, to alloys used in long life liquid metal ion sources.

Liquid metal ion sources provide high current density beams of metallic ions from a source having a small virtual source size. Such high brightness and small source size are required when the ion beam is to be focused with a high resolution of, for example, less than 1 micrometer spot size and utilized in applications such as fabrication of semiconductor microcircuits by ion implantation. In one approach, the high current density and small virtual source size are achieved by emitting the ions from a substrate having a sharp point, such as the point of a needle. In this technique, a needle is covered with a layer of liquid ion source alloy, and a cusp in the liquid alloy at the point of the needle is created by the application of an electrostatic extraction field. This tiny cusp then becomes the emitting source for the ions. As the ions are emitted from the source, more liquid alloy flows from a reservoir down the needle to the cusp to replenish that emitted.

In this type of ion source, a species to be implanted typically resides in a liquid alloy while in the reservoir and on the needle. This alloy must be heated to at least its melting point and remain in the molten state for long periods of time during ion implantation runs. When an alloy is held molten for this long period of time, species which have high vapor pressures can be lost from the alloy in significant amounts, so that the alloy composition changes over time. This change in the composition of the ion source alloy over time can be highly significant and deleterious in the fabrication of semiconductor microcircuits, due to the change in the current density of the ionic species to be implanted in the semiconductor chip. Additionally, the long period of contact between the molten alloy and the emission elements of the liquid metal ion source, including the reservoir and the needle substrate, can cause corrosion and failure of these elements. The lifetime of a liquid metal ion source is often limited by the attack and corrosion of the emission elements by the molten alloy, and such corrosion can also undesirably change the emission characteristics of an operating ion source over time.

The most direct approach to providing an evaporation source for an ionic species is to provide the species in its elemental, unalloyed form. However, many important dopant metal and metalloid ions for implantation into active areas of microcircuits, such as arsenic, antimony and phosphorus, have high vapor pressures at their melting points, resulting in significant evaporation and loss of the element. The melting points are also rather high, so that corrosion of the evaporation elements occurs when the pure liquid metal and the evaporation element are in contact for long periods of time.

An alternative approach is to form an alloy of the desired ion evaporation species with other metal or metalloid constituents chosen so that the melting point of the alloy is lowered below that of the component elements, and further so that the corrosion of the emission elements by the liquid alloy is reduced, as compared with the unalloyed elements. Conventionally, the alloy has been chosen to be of eutectic or near-eutectic composition. The presence of a eutectic reaction results in the depression of the liquidus temperatures of the alloys. The use of a eutectic or near-eutectic composition liquid alloy in a liquid metal ion source allows the source to be operated with the liquid alloy at a minimum temperature, thereby reducing the corrosion rate of the alloy on the evaporation source elements. Ions of both the desired species and the alloying elements are emitted from the source, but the desired species may be selected for implantation using a velocity filter which acts as a mass separator to pass only the selected species.

A further important consideration in the selection of liquid metal ion source alloys is the wetting of the source elements by the alloy. The alloy must wet the evaporation elements sufficiently so that it forms a liquid layer on the evaporation elements, and so that additional metal can flow from the reservoir to the needle tip during continuous emission runs. The attainment of sufficiently good wettability and minimization of corrosion are difficult to achieve simultaneously, since wettability is generally thought to require a degree of chemical reaction between the liquid alloy and the evaporation element, and this reaction also tends to produce the undesirable corrosion.

By providing the species to be evaporated in a eutectic or near-eutectic alloy, liquid metal ion sources having acceptable lifetimes have been developed for ion species other than arsenic. For example, sources for gold and silicon operate just above the eutectic temperature of the alloy system, and typically achieve operating lifetimes in excess of 50 hours. Unfortunately, the lifetime and stability of the best current ion sources for arsenic are unacceptable for use in commercial operations.

Consequently, there has existed a continuing need for better arsenic source alloys for use in liquid metal ion sources. Such arsenic alloys desirably would allow the operation of the sources under stable operating conditions, with uniform beam energies and intensities, and for long periods of time without adverse corrosive effects. The present invention fulfills this need, and further provides related advantages.

SUMMARY OF THE INVENTION

The present invention provides a liquid metal ion source and alloy, which utilize a new approach to alloy selection and design. The vapor pressure of the emitted species is low at the alloy melting point, so that the source alloy may be maintained molten in the evaporation source for long periods of time, without significant changes in chemistry. The source exhibits essentially stoichiometric ion evaporation over time and is stable, with little variation in emitted ion intensity with time. Significantly, the alloys do not substantially corrode the emission elements, such as the emission needle or the heater element, so that the source may be operated for long periods of time without the need to change sources.

In accordance with the invention, a liquid metal ion source comprises emission means for emitting positively charged ions of an elemental chemical species, and source means for supplying the species to be emitted to the emission means, the species being supplied in a congruently vaporizing alloy of the elemental species and at least one other element.

More specifically, and in another aspect of the invention, a liquid metal ion source for the element arsenic comprises emission means for emitting positively charged ions of arsenic, and source means for supplying the arsenic, the arsenic being contained in an alloy consisting essentially of arsenic and palladium. preferably, the alloy has a composition of from about 24 to about 33 atomic percent arsenic, the upper end of this range corresponding to the solid state compound pd As. Most preferably, the alloy has a composition of about 24 atomic percent arsenic and about 76 atomic percent palladium, which is thought to be the congruently vaporizing composition at a temperature of 1200° K., an approximate operating temperature of the ion source.

In one approach, a liquid metal ion source for arsenic and palladium may be made by preparing a mixture consisting essentially of palladium and arsenic, forming a source alloy, and placing the source alloy into ion emission means for emitting positively charged ions. A preferred palladium-arsenic source alloy has a composition of from about 24 to about 33 atomic percent arsenic. Preferably, the alloy is formed from the mixture by combustion synthesis, wherein an exothermic reaction is initiated by local rapid heating to a temperature above the mutual ignition temperature of palladium and arsenic. The reaction propagates through the remaining unreacted mixture as a combustion wave, so that the reaction is completed rapidly and with minimal loss of volatile arsenic.

The present approach represents a significant departure from prior practice in the selection of emission alloys for liquid metal ion sources. Previously, pure elements, eutectic-composition alloys, and near-eutectic composition alloys have been used as ion sources. The eutectic and near-eutectic compositions were selected to obtain low melting points in the emission alloys, but it has now been found that other compositions, even though they have higher melting points, can result in near-stoichiometric emission of ions, excellent stability of the ion beam, and acceptable wetting of the substrate without significant corrosion of the substrate. Liquid metal ion sources having greatly extended lifetimes are therefore possible, and these long lifetime sources are exceptionally stable so that commercial ion implantation procedures become feasible.

It will be appreciated that the present invention represents a significant advance in liquid metal ion sources, particularly for metals and metalloids having high vapor pressures, such as arsenic. The sources incorporating the selected alloys are stable with extended operating lifetimes. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
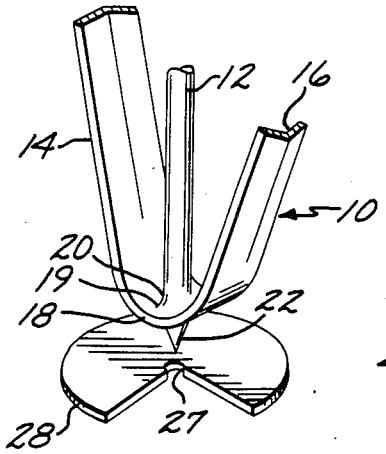
FIG. 1 is a perspective view of one type of liquid metal ion source structure.

The present invention relates to a liquid metal ion source, one type of which is indicated by the numeral 10 in FIG. 1. The ion source 10 includes an ion evaporation substrate needle 12 typically having a tip radius of less than about 20 micrometers and an apex half angle of less than about 49.5°, which extends through a hole (not visible) at the lower end of a generally U-shaped heater element 14. The heater element 14 is in the form of a U-shaped metal ribbon which may incorporate an embossed crease 16 in each leg thereof to increase the columnar strength of the heater element 14. If used, the crease 16 approaches an apex bend 18 at the lower end of the heater element 14, but does not enter the region of the apex bend 18 itself. Ion source alloy (in powdered, chip, or otherwise divided form) is placed in the apex bend 18 of the heater element 14 and an electrical current, produced by a voltage $V_H$, is passed through this heater element 14, so that the alloy melts and naturally forms a reservoir 19 of liquid metal in the apex bend 18 of the heater element 14. The reservoir 19 remains stationary in the apex bend 18 under the influence of gravity because surface tension tends to minimize the surface area of the meniscus 20 of the liquid metal.

The needle 12 passes through a non-circular hole (not visible) in the heater element 14, so designed as to allow liquid metal to flow to a needle tip 22 yet still retain the needle 12. In proper operation of the ion source 10, heating of the heater element 14 melts the source alloy in the reservoir 19 to wet the inner surface of the apex bend 18 of the heater element 14. The molten source alloy conducts heat to the needle 12 so that the molten alloy is wet to the needle 12. Ultimately, the molten alloy flows along the needle 12 to the needle tip 22, for subsequent ion evaporation.

Figure 2:
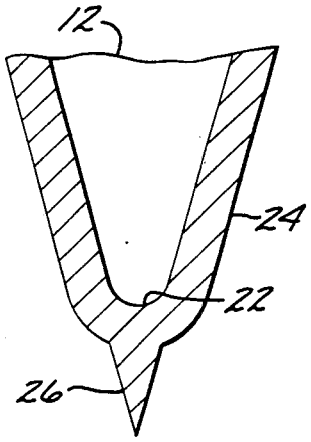
FIG. 2 is an enlarged cross-sectional view of a detail of FIG. 1, illustrating the point of the emitter needle.

Referring to FIGS. 1 and 2, the liquid source alloy flows from the reservoir 19 located in the apex bend 18 toward the tip 22 of the needle 12, forming a liquid layer 24 along the tip 22 of the needle 12. At the very tip of the needle 12, where the liquid layers 24 from the sides of the needle 12 meet, the action of an applied external electrostatic field, produced by an extraction electrode 28, draws the liquid layers 24 downwardly to form a cusp 26. The ions emitted by the ion source 10 are preferably emitted only from the cusp 26, located adjacent the extreme end of the needle tip 22, so that ions appear to emanate from a point source of extremely small dimensions. Positively charged ions are drawn from the cusp 26 by an electrostatic field set up between the ion source 10 and the extraction electrode 28 through the application of a voltage $V_E$. Ions leave the cusp 26 and pass through an opening 27 in the extraction electrode 28. With this configuration, the brightness of emitted ions at the cusp 26 can be very high.

The liquid in the layer 24 must flow from the reservoir 19 located in the apex bend 18 down the surface of the needle 12 to the cusp 26, for emission to be initiated and sustained. However, it is often difficult to initiate and sustain a flow of alloy from the reservoir 19 into the layer 24 along the needle 12 because of difficulty in wetting the alloy to the substrate. On the other hand, if wetting is too extensive, a chemical interaction between the molten alloy and the solid substrate can result in corrosion of the substrate, so that portions of the substrate are dissolved. As a result, pits, cracks or fissures can form in the needle tip 22, the needle 12 may fail entirely, or multiple cusps may be formed due to the corrosion geometry, so that the source 10 cannot be properly focused.

Figure 3:
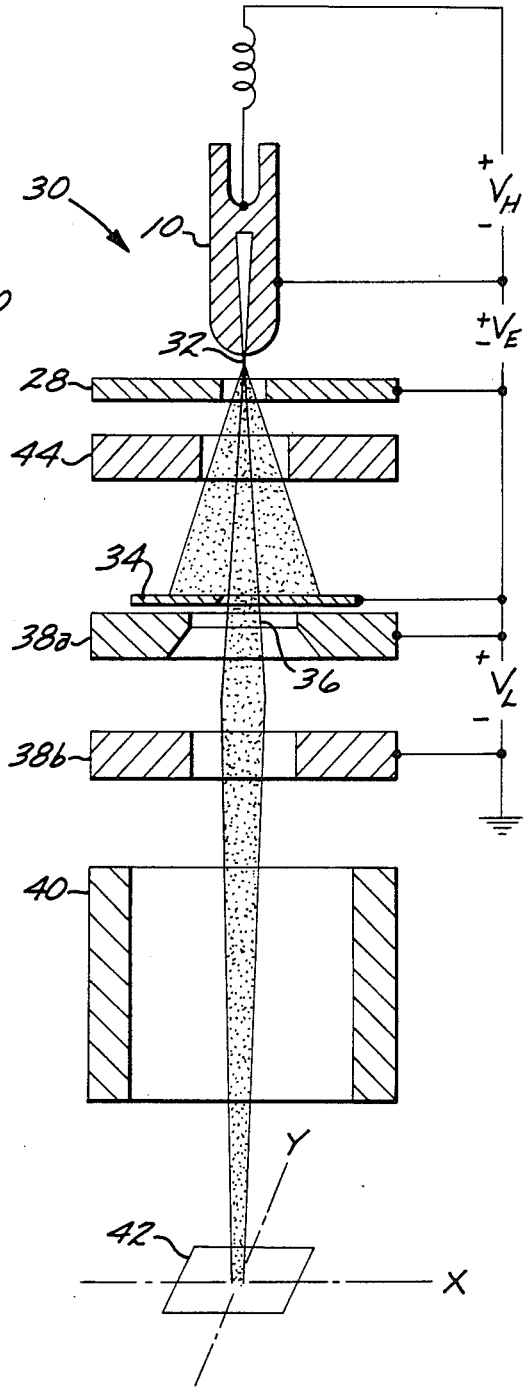
FIG. 3 is a schematic sectional side view of a scanning ion probe employing a liquid metal ion source.

FIG. 3 illustrates one important use of liquid metal ion sources of the type illustrated in FIGS. 1 and 2. The ion source 10 is mounted in a scanning ion probe 30. The extraction electrode 28, which is negatively biased with respect to the needle 12 by the voltage $V_E$, draws positively charged ions out of the cusp 26, to form an ion beam 32. A small portion of this beam 32, typically about 1 milliradian, is allowed to pass through an aperture 34 into the optics section of the scanning ion probe 30. A transmitted beam 36 emerging from the aperture 34 is passed through accelerating electrodes 38 at 3 lb which increase the energy of the beam 36, as the second accelerating electrode **38*b* is negatively biased with respect to the first electrode 38*a* by a voltage $V_L$. The transmitted beam 36 then passes through electrostatic deflection electrodes 40 wherein the beam is deflected from side-to-side to move in a scanning fashion across the surface of a target 42. The transmitted beam 36 can then be used to write various patterns upon the surface of the target 42 in the form of ion implanted zones of controllable shape and type. The beam may also be used to ion machine narrow grooves or small holes. Through the incorporation of a secondary electron detector (not shown), the beam may be used to image the target in a fashion similar to that of a scanning electron microscope. Through the incorporation of a secondary ion mass spectrometer (not shown), the microcomposition of a very small region located on the target 42** may be analyzed in both a qualitative and quantitative manner.

Figure 4:
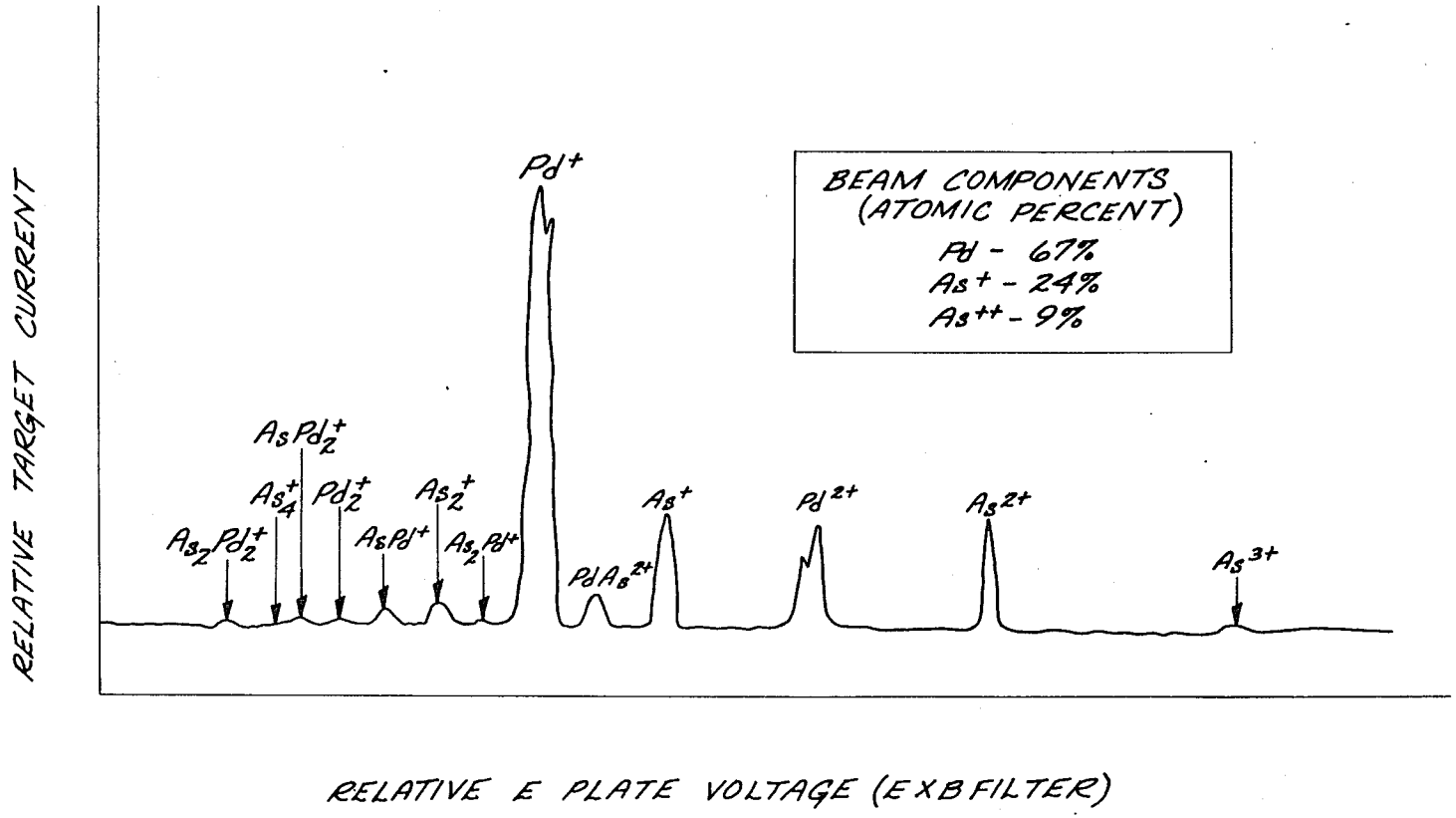
FIG. 4 is a mass spectrum of a liquid alloy having a composition corresponding to $pd_2As$ which has been ion emitted from a tungsten needle.

Preferably, there is also provided an E×B mass separator 44 to deflect ions of differing masses by differing amounts. The mass separator 44 is preferably a Wein velocity filter which acts as a mass separator, because of the very low energy spread of the beam obtained from a liquid metal ion source when properly operated. The mass separator 44 is positioned between the extraction electrode 28 and the aperture 34, and includes means to produce magnetic and electrical fields within the mass separator 44. The fields within the mass separator 44 deflect the moving ions passing therethrough by amounts which depend upon the mass, velocity and charge of the ions in the beam. By varying the strength of the magnetic and electrical fields and the positioning of the mass separator 44, it is possible to allow only a single desirable species to pass through the aperture 34 to be implanted in the target 42, while all other species are deposited on the upper side of the aperture 34. FIG. 4 illustrates the mass spectrum of a beam of ions from one of the preferred sources for arsenic, an alloy having a composition of 67 atomic percent palladium and 33 atomic percent arsenic, plotting the relative target current as a function of the relative plate voltage of the mass separator 44. It is apparent that ions of particular types and charge state may be selected by setting the plate voltage to correspond to the peak in the selected ion species.

In accordance with one embodiment of the invention, the species to be emitted from the ion source 10 has a composition chosen so that the liquid source alloy wets the substrate, is substantially non-reactive with the substrate, and evaporates the alloy components at similar rates. As used herein, the term "congruently vaporizing composition" refers to the composition of an alloy wherein the components evaporate at a rate such that the composition of the liquid does not change at a particular operating temperature of the ion source.

If the conditions for a congruently vaporizing composition are satisifed, the melting point of the alloy, previously thought to be the primary consideration in alloy selection, is found to be less critical, since a congruently vaporizing alloy retains a constant composition as long as any molten material remains. Moreover, the source alloy wets but does not react to corrode the substrate. The composition at which these conditions are met cannot be easily predicted at the present time, and it is therefore necessary to determine congruently vaporizing compositions by empirical studies. If sufficient thermodynamic information is available, congruently vaporizing compositions can be calculated. Such a composition is likely to be associated with a chemical compound in the system, rather than with the lowest melting point eutectic composition.

Figure 5:
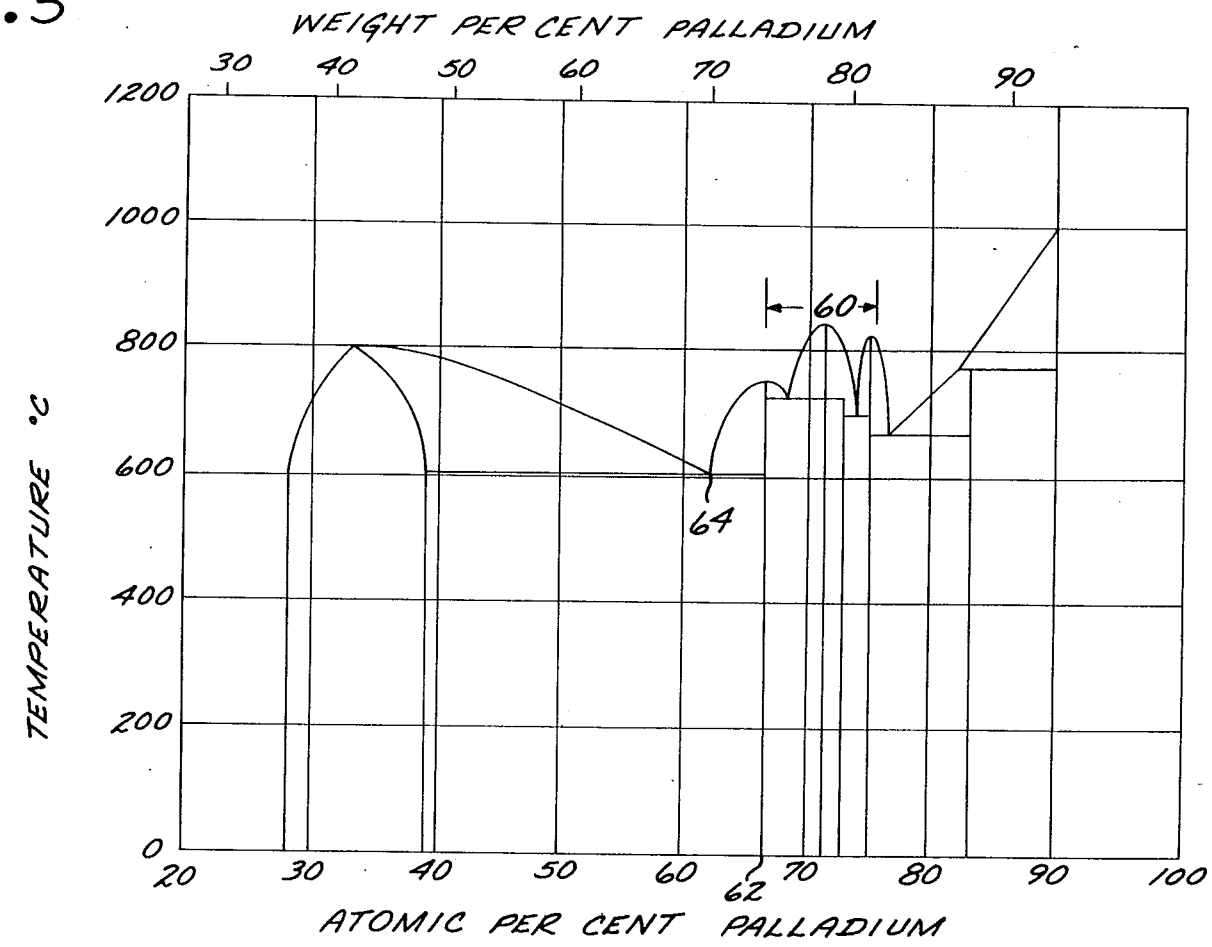
FIG. 5 is a phase diagram of the relevant portion of the palladium-arsenic alloy system.

FIG. 5 is the temperature-composition phase diagram of a portion of the palladium-arsenic system, as presently understood. Arsenic is the preferred ion evaporation species for use in conjunction with the present invention. It has been found that alloys of arsenic with palladium meet the above-identified conditions for selection of an ion source alloy. Liquid melts of palladium-arsenic alloys wet tungsten substrates, but do not corrode the substrates at high rates, even when the source alloys are heated to temperatures well above their liquidus temperatures.

A range of particularly preferred palladium-arsenic alloys for use as ion sources for arsenic is illustrated at numeral 60 in FIG. 5. These alloys contain from about 24 to about 33 atomic percent arsenic, or, conversely, from about 76 to about 67 atomic percent palladium. The composition 67 atomic percent palladium-33 atomic percent arsenic is indicated at numeral 62 in FIG. 5.

It will be seen that alloy compositions having less than 24 atomic percent arsenic and greater than 33 atomic percent arsenic have lower melting points than those indicated within the range 60, but it has been determined that an alloy lying within the range 60 is congruently vaporizing in the liquid state. When such an alloy is ion evaporated in an ion source 10 the composition of the ion beam 32 is approximately that of the liquid source alloy resident upon the tip of the needle 12. The beam and alloycompositions remain essentially constant during extended periods of ion evaporation from such an alloy, and this condition is approximately maintained for other alloys in the range from about 24 to about 33 atomic percent arsenic. This result indicates that the palladium and arsenic evaporation from the surface is essentially as ions. Alloys lying outside this range are operable. Such alloys wet and do not corrode the substrate, but are less preferred because the ionic species evaporate at different rates. The ion source 10 can therefore operate in a steady state condition for long periods of time, since the composition of the liquid metal of the ion source does not change substantially with time. The boxed legend of FIG. 4 indicates the ion beam composition of an ion evaporated alloy containing 67 atomic percent palladium and 33 atomic percent arsenic. The beam also contains about 67 atomic percent palladium and 33 atomic percent arsenic, with the arsenic present as singly and doubly ionized species.

Because the alloy composition remains essentially constant during extended evaporation runs, the reservoir 19 may be readily replenished by simply adding more of the solid material having an overall stoichiometric composition equal to that of the congruently vaporizing composition. There is no need to add excessive amounts of either constituent element in order to bring the overall composition of the alloy melt back to a nominal value, due to a preerential evaporation of one of the elements.

By contrast, it has been conventional to prepare liquid metal ion source alloys from low melting point eutectic compositions, such as that indicated at the numeral 64 in FIG. 5. Generally, an alloy such as that of the eutectic composition 64 does not exhibit substantially similar evaporation rates for the components in the alloy, and thus the composition of the alloy on the emitter needle 12 continually changes. Constant adjustments of the operating parameters for the ion source are therefore required to insure stable operation of the source 10, thus making control of the ion source more difficult. The eutectic composition 64 has a melting point of about 610° C., while the alloys lying in the range 60 of from about 24 to about 33 atomic percent arsenic have significantly higher liquidus temperatures of from about 700 to about 830° C. A lower melting point has previously been thought preferable during extended continuous contact with the liquid metal alloy, to avoid the adverse effects of corrosion of the emission elements, such as the needle 12 and the heater element 14. Surprisingly, this has not been found to be the case for the alloy compositions of the present invention, and in particular the alloy compositions corresponding to 67 atomic percent palladium-33 atomic percent arsenic has been found to have an extremely long operating lifetime when used in conjunction with tungsten emission elements. This extended lifetime is observed in spite of the fact that the ion source 10 utilizing a liquid alloy of this composition must be operated at a temperature greater than about 760° C. By contrast, a source using the eutectic composition 64 may be operated at a significantly lower temperature, just above the eutectic temperature of about 610° C.

As indicated, the preferred palladium-arsenic alloys contain from about 24 to about 33 atomic percent arsenic. It is believed that a palladium-arsenic alloy lying within this composition range will exhibit congruent ion evaporation of palladium and arsenic. Experiments have indicated that the composition 76 atomic percent palladium-24 atomic percent arsenic is the ideal alloy to achieve congruent ion evaporation at a temperature of about 930° C.

It should also be noted that, for a congruently vaporizing composition, the total vapor pressure of the system is near a minimum, so that the loss of elements by evaporation is minimized.

Although the palladium-arsenic alloys of from about 24 to about 33 atomic percent arsenic do not corrode tungsten substates, excellent wetting of the substrate is attained. For example, an alloy of 33 atomic percent arsenic is found to wet a tungsten substrate so that evaporation from the cusp 26 and alloy flow along the needle 12 are achieved.

Because elemental arsenic exhibits a high vapor pressure at preparation temperatures, it can be easily lost during conventional source alloy fabrication procedures. It has therefore been found particularly desirable to fabricate the preferred palladium-arsenic alloys by a combustion synthesis technique, also termed self-sustaining high-temperature synthesis. In this approach, finely divided palladium and arsenic powders are mixed together, and then cold pressed to form a pellet. The subsequent processing has been demonstrated for pressed powders, and it is believed that an unpressed mixture is also operable with reduced efficiency. In the preferred approach palladium and arsenic powders having diameters of less than 74 micrometers were blended in the proper stoichiometric ratios and pressed, at a pressure of 25000 psi and at ambient temperature, into right circular cylinders having diameters of about ½ inch and heights of about ½ inch. The weighing, mixing and pressing steps were carried out under inert atmospheres such as argon or helium in a glove box, to minimize oxidation of the arsenic powder. The oxygen level in the glove box was typically less than 1 part per million.

The cylindrical pellet was placed into a quartz crucible, which in turn was placed on a graphite strip in a glove box having an inert atmosphere. The pellet was rapidly heated to the ignition temperature of the exothermic reaction between palladium and arsenic by passing a DC current of several hundred amperes through the graphite strip, heating the strip, the crucible and the pellet.

The rapid heating of one side of the pellet raises a volume of material to a temperature greater than the ignition temperature of the palladium-arsenic mixture. At such a temperature, the elements react and combine in an exothermic reaction. The heat evolved by the reaction heats the immediately adjacent volume of unreacted material, which in turn exothermically reacts. In this way, a reaction or combustion wave passes through the mixture, leaving behind an alloy which has essentially reacted completely and is suitable for use in a liquid metal ion source. The combustion wave requires about 1–2 seconds to traverse the cylindrical pellets, so that the mixture is at an elevated temperature for a very short time and only a small amount of arsenic is lost.

The combustion synthesis technique provides one convenient means for preparing the desired alloys of palladium and arsenic, although other methods are also acceptable.

An ion source 10 having a tungsten needle and heater element was operated using an alloy of 67 atomic percent palladium-33 atomic percent arsenic as a source of arsenic. FIG. 4 illustrates the mass spectrum of the emitted beam of ions. Ion emission is essentially stoichimetric, with the atomic percentages of the constituents in the beam essentially equal to that of the source alloy. The mass spectrum exhibits excellent definition of the peaks, so that ionic species for implantation may be selected by controlling the plate voltage of the mass separator 44. In particular, either singly or doubly ionized arsenic atoms may be selected for implantation. The energy spread of doubly ionized arsenic atoms was found to be less than 15 electron volts and 20 microamps extracted current, and a target current of over 30 picoamps of doubly ionized arsenic ions was obtained with a beam acceptance half angle of 1.5 milliradians.

A 200×200 micrometer region of a silicon wafer was implanted by this technique, and compared with a region on the same wafer which was implanted through a mask by standard ion implantation of arsenic. The implanted profiles were analyzed and it was concluded that the implanted profiles of focused and conventional arsenic ions were substantially the same.

The operating characteristics of the tungsten source using the 33 atomic percent arsenic composition as the source alloy were observed to be excellent. Upon heating, the alloy melts at about 773±3° C. Excellent wetting of the tungsten was noted. No loss of arsenic by thermal evaporation was observed at operating temperatures as high as about 1100° C., indicating that the arsenic is effectively retained within the liquid alloy. Ten different sources were prepared and operated, in each case for times of between 50 and 120 hours. In no case was use of a particular source terminated because of failure or corrosion of the emission elements. The sources were inspected after operation, and essentially no corrosion of the elements was observed. Other corrosion tests were conducted by placing the liquid alloy in contact with a piece of tungsten in a furnace (not in an ion source) for a period of over 150 hours at a temperature of about 800° C. Essentially no corrosion or other chemical reaction between the liquid alloy and the substrate was observed upon cooling and sectioning of the material. It is therefore believed that the ion sources utilizing palladium-arsenic alloys may be operated in a stable fashion for periods of hundreds of hours.

The operation of the ion sources using palladium-arsenic alloys as a source of arsenic is extremely stable. The operating temperature can be maintained very close to the alloy liquidus temperature, and there are insignificant variations in source current or voltage. Experience has shown that the stable ion sources may be operated without the conventional ion source feedback controls required for the evaporation of other alloys such as eutectic compositions.

As will now be appreciated, the ion sources of the present invention achieve operating performance otherwise unavailable for arsenic. The sources provide effective currents of the desired ion species, are stable, and operate over extended lifetimes without failure of the evaporation elements. Although a particular embodiment of the invention has been described in detail for purposes of illustration, various modifications may be made without departing from the spirit and scope of the invention. Accordingly, the invention is not to be limited except as by the appended claims.

What is claimed is:

1. A liquid metal ion source, comprising:
emission means for emitting positively charged ions of an elemental chemical species; and
source means for supplying the species to be emitted to said emission means, said species being supplied in a congruently vaporizing non-eutectic alloy of the elemental chemical species and at least one other element.

2. The ion source of claim 1, wherein the alloy containing the species is furnished as a solid having a composition corresponding to that of a congruently vaporizing liquid alloy.

3. The ion source of claim 1, wherein the alloy containing the species is furnished as a mixture of at least two solid materials, the mixture having a net composition corresponding to that of a congruently vaporizing composition.

4. A liquid metal ion source, comprising:
emission means for emitting positively charged ions of an elemental chemical species; and
source means for supplying the species arsenic to be emitted to said emission means, said species being supplied in a congruently vaporizing alloy of the elemental chemical species and at least one other element.

5. The ion source of claim 4, wherein the species is supplied in an alloy of arsenic and palladium.

6. The ion source of claim 4, wherein the species is supplied in an alloy consisting essentially of 76 atomic percent palladium and 24 atomic percent arsenic.

7. A process for making a liquid metal ion source, comprising the steps of:
preparing a mixture consisting essentially of palladium and arsenic;
raising the temperature of the mixture to the ignition temperature of the palladium-arsenic mixture by rapid heating, whereby an exothermic reaction wave is produced and traverses the mixture, and a source alloy of palladium and arsenic is thereby formed; and
placing the source alloy into ion emission means for emitting positively charged ions.

8. The process of claim 7, including the additional step, after said step of preparing and before said step of raising, of:
compressing the mixture to form a pellet.

9. The process of claim 7, wherein the source alloy has an arsenic content of from about 24 to about 33 atomic percent.

10. The process of claim 7, wherein said mixture is in a quartz crucible during said step of raising.

11. The process of claim 7, wherein said mixture is heated by a resistance heater.

12. The process of claim 7, wherein said step of raising is conducted in an inert atmosphere.

13. The process of claim 7, wherein the arsenic and palladium are furnished as powders.

* * * * *